US006784650B2

(12) United States Patent
Hein et al.

(10) Patent No.: US 6,784,650 B2
(45) Date of Patent: Aug. 31, 2004

(54) CIRCUIT CONFIGURATION FOR GENERATING A CONTROLLABLE OUTPUT VOLTAGE

(75) Inventors: Thomas Hein, München (DE); Patrick Heyne, München (DE); Thilo Marx, Villingen-Schwenningen (DE); Torsten Partsch, Raleigh, NC (US)

(73) Assignee: Infienon Technologies AG, Munich (DE)

( * ) Notice: Subject to any disclaimer, the term of this patent is extended or adjusted under 35 U.S.C. 154(b) by 0 days.

(21) Appl. No.: 10/438,362

(22) Filed: May 14, 2003

(65) Prior Publication Data

US 2003/0205992 A1 Nov. 6, 2003

Related U.S. Application Data

(63) Continuation of application No. PCT/DE01/03974, filed on Oct. 18, 2001.

(30) Foreign Application Priority Data

Nov. 14, 2000 (DE) ..... 100 56 293

(51) Int. Cl.[7] ..... G05F 1/40; G05F 1/44

(52) U.S. Cl. ..... 323/284; 323/274; 323/282

(58) Field of Search ..... 323/282, 284, 323/283, 285, 274, 273, 272

(56) References Cited

U.S. PATENT DOCUMENTS

| | | | | |
|---|---|---|---|---|
| 4,810,948 | A | 3/1989 | Takuma | 323/280 |
| 5,072,134 | A | 12/1991 | Min | 327/536 |
| 5,408,172 | A | 4/1995 | Tanimoto et al. | 323/273 |
| 5,907,237 | A | 5/1999 | Sekimoto | 323/282 |
| 5,917,311 | A | 6/1999 | Brokaw | 323/280 |
| 6,108,804 | A | 8/2000 | Derner | 714/721 |
| 6,285,176 | B1 | 9/2001 | Marx et al. | 323/313 |
| 6,433,526 | B2 * | 8/2002 | Micheli | 323/284 |
| 6,522,115 | B1 * | 2/2003 | Greitschus | 323/288 |
| 6,538,417 | B2 * | 3/2003 | Marty et al. | 323/282 |

FOREIGN PATENT DOCUMENTS

| | | | |
|---|---|---|---|
| DE | 40 06 306 A1 | 12/1990 | H01L/23/58 |
| DE | 199 50 541 A1 | 6/2001 | G05F/1/10 |

* cited by examiner

*Primary Examiner*—Bao Q. Vu
(74) *Attorney, Agent, or Firm*—Laurence A. Greenberg; Werner H. Stemer; Gregory L. Mayback

(57) ABSTRACT

A switching network with trimmable resistors lies in a control loop of a voltage generator that can be switched off from the supply voltage by a logic device. The logic device and also the switching network are driven by the same signals. The circuit configuration can be used for trimming or switching off the output voltage generated by the voltage generator during the functional test. As many settings as possible for the output voltage can be tested by a small number of control signals.

10 Claims, 2 Drawing Sheets

CIRCUIT CONFIGURATION FOR GENERATING A CONTROLLABLE OUTPUT VOLTAGE

CROSS-REFERENCE TO RELATED APPLICATION

This application is a continuation of copending International Application No. PCT/DE01/03974, filed Oct. 18, 2001, which designated the United States and was not published in English.

BACKGROUND OF THE INVENTION

FIELD OF THE INVENTION

The invention relates to a circuit configuration for generating a controllable output voltage having a voltage generator and a comparator, which, on an output side, is connected to a control terminal of the voltage generator.

Voltage generators for generating voltage levels that deviate from the supply voltage within an integrated circuit are necessary in many cases. In integrated volatile semiconductor memories, so-called dynamic random access memories (DRAMs), for example, a negative voltage is generated which negatively biases the semiconductor substrate with respect to the applied supply voltage. The positive supply voltage is fed to the voltage generator, the latter generating the negative substrate bias voltage from the supply voltage.

During test operation, in particular, it is necessary for the semiconductor chip to be operated at different substrate bias voltages. Thus, during test operation, it is desirable that the substrate bias voltage generator can be switched off, on the one hand, and, on the other hand, can be trimmed in the switched-on state in a manner dependent on different control signals, i.e. can be set to different negative output voltages. The influence of negative substrate bias voltages of different magnitudes on the functionality of the semiconductor chip can thereby be tested.

Control signals are required for setting the respectively desired output voltage of the substrate bias voltage generator, the control signals being fed to the semiconductor chip during test operation. In order to achieve a high integration density of the components on the chip and hence a small chip area, as few control signals as possible should be necessary in order to be able to set as many operating states of the voltage generator as possible.

SUMMARY OF THE INVENTION

It is accordingly an object of the invention to provide a circuit configuration for generating a controllable output voltage usable for example as a substrate bias voltage of an integrated circuit that overcomes the above-mentioned disadvantages of the prior art devices of this general type, which requires the least possible area consumption in an integrated realization.

With the foregoing and other objects in view there is provided, in accordance with the invention, a circuit configuration for generating a controllable output voltage. The circuit configuration contains a voltage generator having input terminals receiving a supply voltage, an output terminal providing the controllable output voltage and, a control terminal controlling the controllable output voltage. A comparator is provided and has inputs receiving a reference signal and a comparator control signal derived from the controllable output voltage and an output connected to the control terminal of the voltage generator. Supply terminals are provided for receiving the supply voltage to be forwarded to the voltage generator. Transistors are provide and have control terminals and controlled paths receiving the supply voltage to be forwarded to the voltage generator. A first of the transistors is connected between a first of the supply terminals and one of the input terminals of the voltage generator, and a second of the transistors is connected between a second of the supply terminals and another of the input terminals of the voltage generator. A logic device is connected to the control terminals of the transistors and outputs a transistor control signal for driving the transistors. A switching network is connected to the comparator and receives at least a first control signal and a second control signal. A level of the comparator control signal derived from the controllable output voltage is dependent on the first and second control signals.

In the case of the invention, control signals are fed on the one hand to the switching network for setting the magnitude of the output voltage, and, on the other hand, the same control signals are fed to a logic device, which serves, through the driving of corresponding transistors, for switching off the supply voltage that can be fed to the voltage generator. As a result, all possible state combinations of the control signals are used to set the magnitude of the output voltage, including the switching-off of the voltage generator. Consequently, only a few control signals are required and, accordingly, few signal lines for providing the control signals are required. The area requirement in an integrated realization is therefore limited to the most essential amount.

The logic device contains a corresponding logic switching device which generates a control signal that causes the supply voltage of the voltage generator to be switched off when a single predetermined combination of signal states of the control signals is present at the logic device.

The logic device contains a gate for performing a logic operation. One of the control signals is fed to the gate of the logic device and also to the switching network in non-inverted form. The rest of the control signals are fed to the gate of the logic device in inverted form, but to the switching network in non-inverted form, or respectively vice versa. The gate is preferably one that carries out a NOT-AND combination (NAND gate).

The switching network preferably contains a series circuit having a number of resistors corresponding to the number of control signals. Switches are respectively disposed in parallel with the resistors, which switches can be controlled by a respective one of the control signals. The switches contain, for example, two transistors of complementary conductivity types, whose controlled paths are connected in parallel and whose control terminals are controlled by complementary control signals derived from the respective control signal.

For an as linear as possible control of the output voltage in a manner dependent on the control signals, it is provided that the resistances of the resistors are proportional to one another, i.e. the resistances of the resistors differ from one another by a constant multiplicative factor. In particular, the resistances of the resistors may be a sequence of powers of two of a basic resistance.

The voltage generator is a regulator that generates the output voltage from the supply voltage fed to it. In particular, the voltage generator generates a voltage lying outside the supply voltage that is fed. If the supply voltage is positive, e.g. has a value of +2.5 volts with respect to reference-ground potential, then the substrate bias voltage is in the negative direction relative to reference-ground potential and has a value of approximately −0.7 volt. As is known such a voltage pump operates in a clocked fashion. As a result of the clocked-controlled charging and charge-reversal of capacitances within the voltage pump, the negative substrate bias voltage is generated from the positive supply voltage. The magnitude of the output voltage is regulated by the clocked operation of the voltage generator being switched on and off and thus being kept within a specific bandwidth.

The control signals cause a suitable number of resistors of the switching network to be short-circuited. The control signal for the comparator, which is derived from the generated output voltage, e.g. the substrate bias voltage, is shifted in a predetermined manner by this measure, so that the voltage generator accordingly supplies a different output voltage. Overall, through a predetermined combination of signal states of the control signals, either the voltage generator can be completely switched off or the magnitude of its output voltage can be set accordingly.

The resultant setting possibility for the magnitude of the generated output voltage, e.g. substrate bias voltage, is important particularly during test operation in order to check the semiconductor chip for functionality and operational reliability at different substrate bias voltages. During test operation, the control signals are input into the chip by a digital control word, buffer-stored and forwarded to the logic device and the switching network. The semiconductor chip can be put into the test mode only after a very particular command input, which is not present in normal operation. Thus, although the capability of setting the output voltage is afforded in test operation, it is switched off in normal operation. During normal operation the voltage generator is always supplied from the supply voltage and the switches of the switching network have a fixedly predetermined, invariable switching state.

Other features which are considered as characteristic for the invention are set forth in the appended claims.

Although the invention is illustrated and described herein as embodied in a circuit configuration for generating a controllable output voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
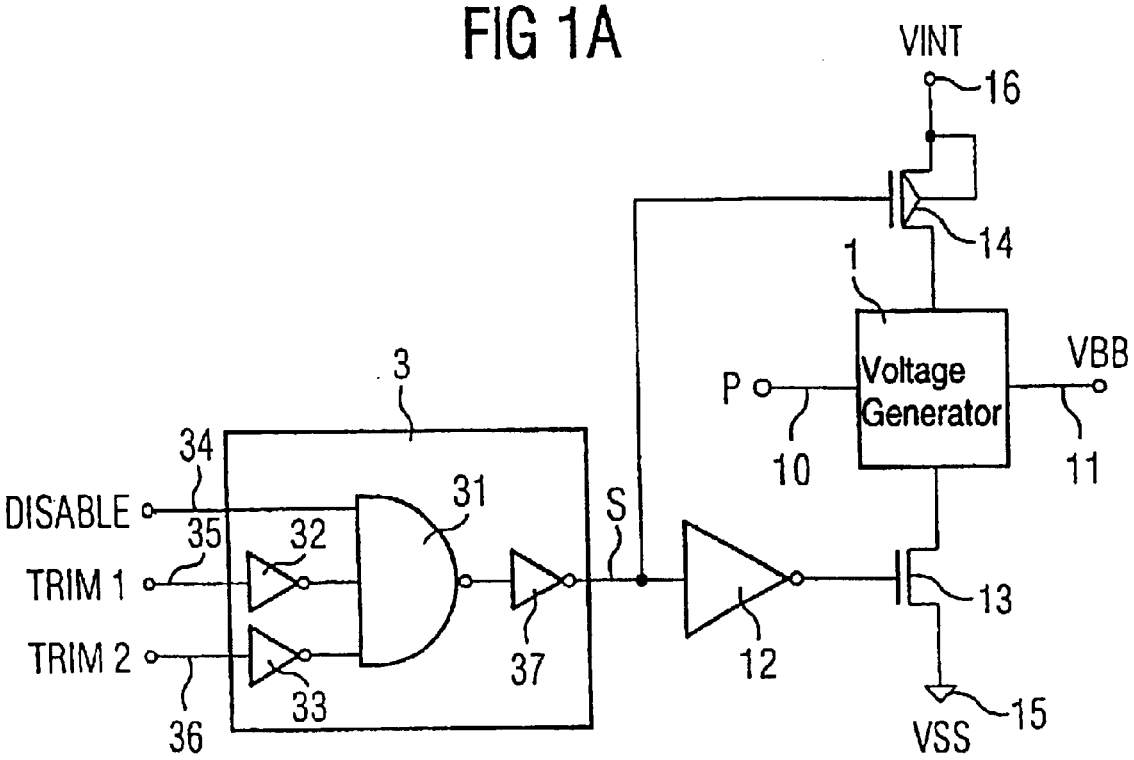
FIGS. 1A and 1B are circuit diagrams of a circuit configuration according to the invention.

Referring now to the figures of the drawing in detail and first, particularly, to FIG. 1A thereof, there is shown a voltage generator 1, which generates a voltage VBB present at an output terminal 11 from a supply voltage VSS, VINT present at the terminals 15, 16. The supply voltage VINT is +2.5 volts, for example, relative to ground VSS. The output voltage VBB is a voltage directed in the negative direction by comparison therewith, having a value of at least −0.4 volt relative to ground VSS. The output voltage VBB is used in a DRAM, for example, in order to negatively bias the substrate. What is thereby achieved is that storage capacitors, one electrode of which is disposed in the substrate, are better insulated from one another. The voltage generator 1 is a so-called voltage pump that generates the negative substrate bias voltage VBB from the supply voltage VINT by clocked operation. For this purpose, capacitors are charged from the supply voltage VINT, subjected to polarity reversal and discharged into an output capacitance, with the result that the negative substrate bias voltage VBB builds up. The charging, polarity-reversal and discharging processes within the voltage pump 1 are controlled in clocked fashion. A pump control signal P at a control terminal 10 of the voltage pump 1 ensures that the clocked operation can be switched on and off.

The supply voltage terminals of the voltage pump are connected to the terminal 15 for the ground potential VSS via an n-channel MOS transistor 13, and to the terminal 16 for the positive supply potential VINT via a p-channel MOS transistor 14. The transistors 13, 14 having complementary conductivity types are driven by complementary components of a control signal S. The control signal S is fed directly to the gate terminal of the transistor 14 and is fed to the gate terminal of the transistor 13 after having been inverted by an inverter 12. The control signal S is provided at the output of a logic device 3. A first control signal DISABLE is fed to the logic device 3 on the input side at a terminal 34. Two control signals TRIM1, TRIM2 are additionally fed at terminals 35, 36. A NAND gate 31 receives the control signal DISABLE in non-inverted form, and the control signals TRIM1, TRIM2 after the latter have been inverted by respective inverters 32, 33. Connected downstream of the output of the NAND gate 31 is an inverter 37, at which, in turn, the control signal S can be tapped off on the output side.

The voltage pump 1 is supplied with the supply voltage if the control signal S has a low level. The p-channel MOS transistor 14 is then in the ON state, as is the n-channel MOS transistor 13. The voltage pump 1 is isolated from the supply voltage VSS, VINT if the transistors 13, 14 are turned off when the control signal S has a high level. This is the case if the control signal DISABLE has a high level and the control signals TRIM1, TRIM2 respectively have a low level. In the event of this single combination of the control signals DISABLE, TRIM1, TRIM2, the voltage pump 1 is isolated from the supply voltage VSS, VINT. In all other combinations of the signal states of the control signals DISABLE, TRIM1, TRIM2, the voltage pump 1 is connected to the supply voltage VSS, VINT.

Figure 1B:
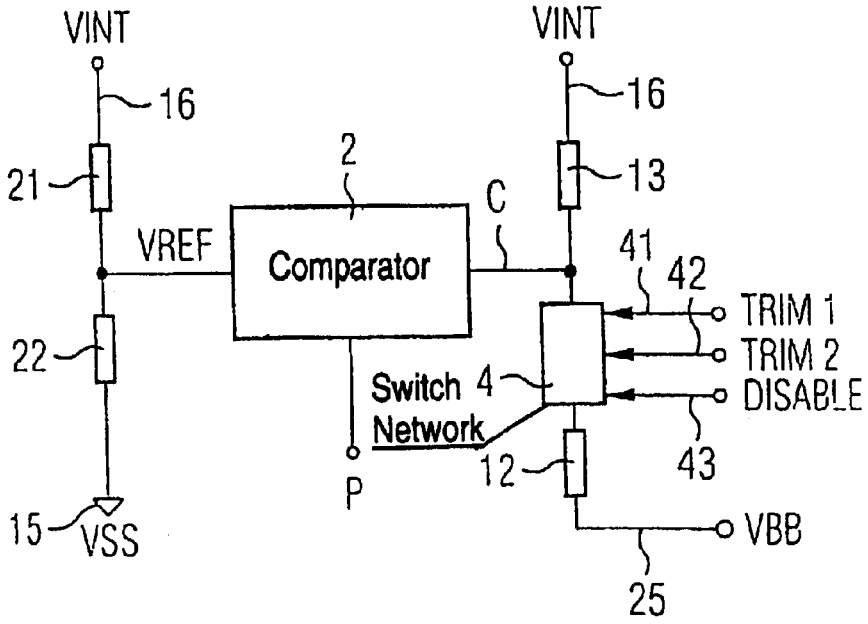

The signal P at the terminal 10 of the voltage pump 1 is generated by the circuit illustrated in FIG. 1B. A comparator 2 is provided for this purpose, to which a reference signal VREF and an actuating signal C are fed. The control signal P is generated in a manner dependent on the relationship between the signals VREF and C. The reference signal VREF is generated from the supply voltage VSS, VINT for example by voltage division of two series-connected resistors 21, 22. By way of example, VREF has a level of 1.2 volts. The actuating signal C is derived from the substrate bias voltage VBB tapped off at a terminal 25 within the integrated semiconductor chip. For this purpose, a voltage divider is provided, which is connected between the terminal 25 and the terminal 16 for the positive supply potential VINT. The voltage divider contains a resistor 12, a switching network 4 that is still to be described in more detail, and also a resistor 13 on the supply potential side. If the actuating signal C rises and exceeds a threshold value prescribed by the reference signal of 1.2 volts, the voltage pump 1 is switched on in order to drive the substrate bias voltage VBB further negative. If the actuating signal C falls below another internal level of the comparator 2 described by the reference signal at 1.2 volts, the voltage pump 1 is switched off by the signal P. The substrate bias voltage VBB then gradually rises again as a result of leakage current losses until the voltage pump 1 is to be switched on again.

Figure 2:
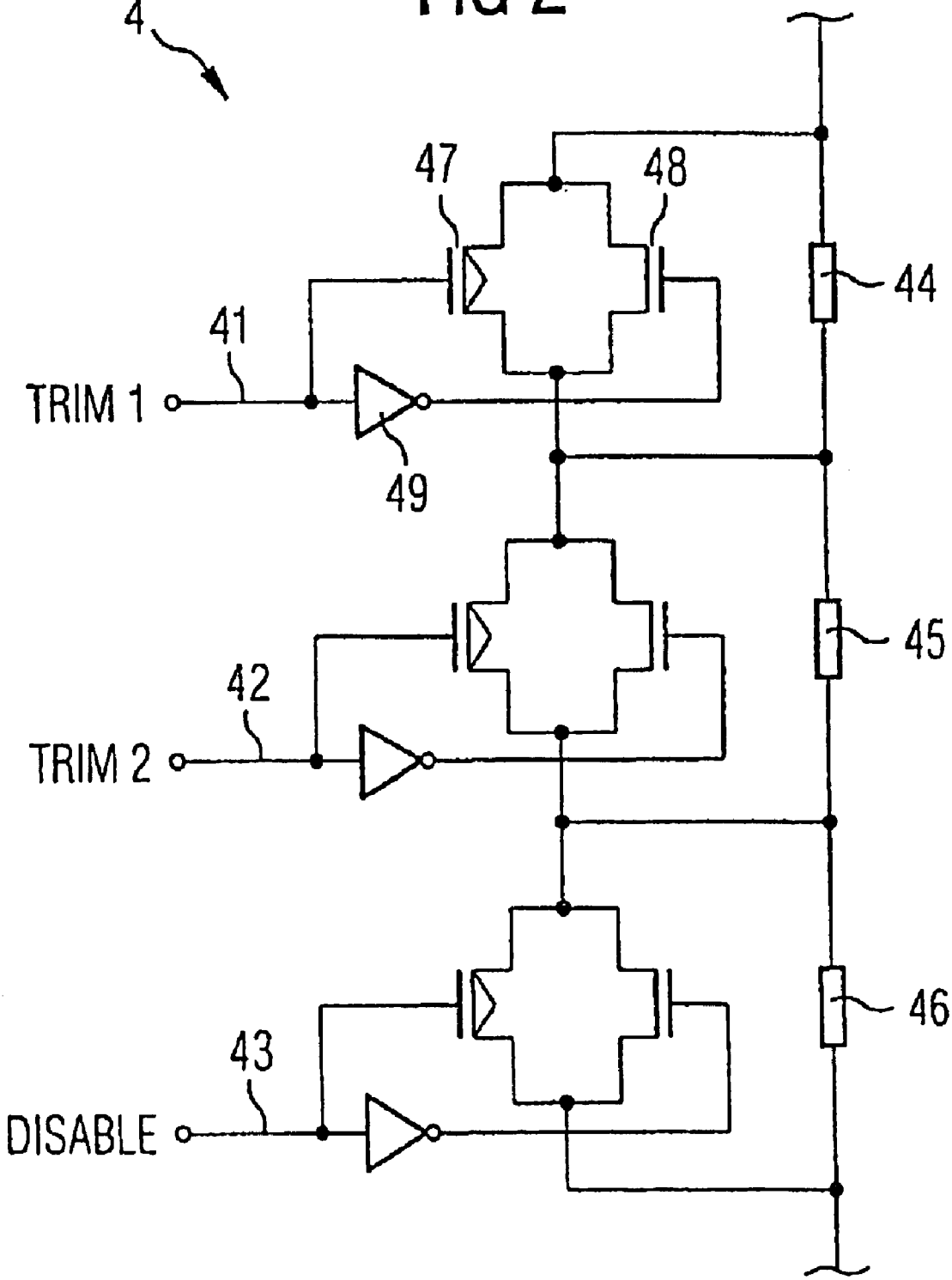
FIG. 2 is a circuit diagram of a detailed exemplary embodiment of the switching network illustrated in FIG. 1.

The switching network 4 is illustrated in detail in FIG. 2. The switching network 4 contains three series-connected resistors 44, 45, 46. Connected in parallel with each of the resistors 44, 45, 46 is a switch driven by one of the control signals TRIM1, TRIM2 or DISABLE. Each of the switches is constructed identically. Thus, the switch connected in parallel with the resistor 44 contains a p-channel MOS transistor 47 and also an n-channel MOS transistor 48, whose drain-source paths, for their part, are connected in parallel and, moreover, in parallel with the resistor 44. The transistor 47 is driven directly by the control signal TRIM1, and the transistor 48 indirectly via an inverter 49. If the control signal TRIM1 has a high level, then the switch formed from the transistors 47, 48 is turned off and the resistor 44 is active. If the control signal TRIM1 has a low level, the switch 47, 48 is in the ON state, so that the resistor 44 is short-circuited. The same applies correspondingly to the rest of the control signals and the switches connected in parallel with the assigned resistors.

Through a suitable combination of signal states of the control signals TRIM1, TRIM2, DISABLE, it is possible to set all combinations of the resistors 44, 45, 46 as described above.

What this results in is that the actuating signal C is influenced, on the one hand, by the instantaneous magnitude of the substrate bias voltage VBB and, on the other hand, additionally by the instantaneous setting of the control signals TRIM1, TRIM2, DISABLE. In the regulation relationship with the comparator 2 and the reference signal VREF thereof and the signal P for controlling the voltage pump 1, the substrate bias voltage VBB generated by the voltage pump 1 is set to a desired magnitude. Generally, the setting of different magnitudes of the substrate bias voltage VBB generated by the voltage pump 1 is referred to as trimming. In addition, the voltage pump 1 can be completely switched off by the combination of the control signals DISABLE, TRIM1, TRIM2 that is decoded in the logic device 3.

In a dimensioning example, the resistor 21 has a value of 13R, for example, the resistor 22 has a value of 12R, the resistor 13 has a value of 13R, the resistor 12 has a value of 15R. In order to achieve a linear influencing of the control signal C in a manner dependent on the substrate bias voltage VBB, the resistor 44 has a value of 1R, the resistor 45 has a value of 2R, the resistor 46 has a value of 4R. The resistors 44, 45, 46 in each case differ from one another by a constant factor of two. They form a sequence of powers of 2 of the value R of the resistor 44. The resistors 44, 45, 46 are proportional to one another.

The values of the voltage VBB illustrated in the table below and the operating state of the voltage pump 1 mentioned results in a manner dependent on the control signals DISABLE, TRIM1, TRIM2:

| DISABLE | TRIM1 | TRIM2 | Output voltage VBB |
|---|---|---|---|
| 1 | 0 | 0 | Voltage pump 1 switched off |
| 1 | 0 | 1 | −0.9 volt |
| 1 | 1 | 0 | −0.8 volt |
| 1 | 1 | 1 | −1.0 volt |
| 0 | 0 | 0 | −0.4 volt |
| 0 | 0 | 1 | −0.6 volt |
| 0 | 1 | 0 | −0.5 volt |
| 0 | 1 | 1 | −0.7 volt |

It is advantageous that just three control signals can be used both to set seven levels of the substrate bias voltage VBB to be generated and to set the switched-off state of the voltage pump 1. All available signal states of the control signals are used to set the operating characteristics of the voltage pump 1. Just three signal lines on the semiconductor chip are necessary for this purpose.

The invention can be employed particularly advantageously during the testing of the semiconductor chip after the fabrication thereof. For this purpose, the semiconductor chip is brought to a special test operation by the application of a specific sequence of signals and commands to the terminals of the semiconductor chip, which sequence is not permissible and generally cannot be achieved during normal operation. After changeover to the test operation, the automatic test machine inputs to the chip a command indicating that the chip is being tested under different substrate bias voltages. A control word representing a specific state of the control signals DISABLE, TRIM1, TRIM2 is subsequently input. The logic device 3 and the switching network 4 are driven accordingly. Then either the voltage pump 1 is switched off or a specific combination of the resistors 44, 45, 46 within the switching network 4 is set in order to obtain a desired magnitude of the substrate bias voltage VBB. Afterward, a functional test of the semiconductor chip, e.g. a DRAM, is carried out. The same or a similar test can then be carried out with a different combination of the control signals DISABLE, TRIM1, TRIM2.

During normal operation, a specific average value is set for the substrate bias voltage VBB. The control signals TRIM1, TRIM2, DISABLE are preset correspondingly for this purpose, which is achieved for example by fuses or pull-up resistors or pull-down resistors.

We claim:

1. A circuit configuration for generating a controllable output voltage, comprising:

a voltage generator having input terminals receiving a supply voltage, an output terminal providing the controllable output voltage and, a control terminal controlling the controllable output voltage;

a comparator having inputs receiving a reference signal and a comparator control signal derived from the controllable output voltage and an output connected to said control terminal of said voltage generator;

supply terminals for receiving the supply voltage to be forwarded to said voltage generator;

transistors having control terminals and controlled paths receiving the supply voltage to be forwarded to said voltage generator, a first of said transistors connected between a first of said supply terminals and one of said input terminals of said voltage generator, a second of said transistors connected between a second of said supply terminals and another of said input terminals of said voltage generator;

a logic device connected to said control terminals of said transistors and outputting a transistor control signal for driving said transistors; and a signal path connected between said output terminal of said voltage generator and said input of said comparator receiving the comparator control signal, said signal path having a switching network connected to said comparator and receiving at least a first control signal and a second control signal, a level of the comparator control signal derived from the controllable output voltage being dependent on the first and second control signals.

2. The circuit configuration according to claim 1, wherein the first and second control signals are received by said logic device and signal levels of the transistor control signal generated by said logic device, for switching off said transistors, can be generated only in an event of a single combination of states of the first and second signals fed to said logic device.

3. The circuit configuration according to claim 1, wherein said logic device contains a gate performing a logic combination, the first signal received by said logic device is received by said gate and also by said switching network in a non-inverted form, the second signal received by said logic device being received by said gate in an inverted form and also to said switching network in a non-inverted form.

4. The circuit configuration according to claim 3, wherein said gate is a NAND gate.

5. The circuit configuration according to claim 1, wherein said switching network has a series circuit containing at least two resistors and a switch connected in parallel with at least one of said resistors, said switch controlled by a respective one of the first and second control signals.

6. The circuit configuration according to claim 5, wherein said resistors have resistances that differ in pairs by a constant factor.

7. The circuit configuration according to claim 1, wherein said voltage generator is a voltage pump operated in a clocked fashion and whose clocked operation can be switched on and off by a signal present at said control terminal of said voltage generator.

8. The circuit configuration according to claim 7, wherein the supply voltage supplied to said voltage generator is a voltage with respect to a reference-ground potential and in that the controlled output voltage generated by said voltage generator lies outside the supply voltage.

9. The circuit configuration according to claim 6, wherein the constant factor is 2.

10. The circuit configuration according to claim 1, wherein the controllable output voltage of said voltage generator is shifted by said switching network in dependence on the first and second control signals.

* * * * *

UNITED STATES PATENT AND TRADEMARK OFFICE

CERTIFICATE OF CORRECTION

PATENT NO. : 6,784,650 B2
DATED : August 31, 2004
INVENTOR(S) : Thomas Hein et al.

It is certified that error appears in the above-identified patent and that said Letters Patent is hereby corrected as shown below:

Title page,
Item [73], Assignee, should read as follows:
-- Infineon Technologies AG, München (DE) --

Signed and Sealed this

Fourteenth Day of December, 2004

JON W. DUDAS
*Director of the United States Patent and Trademark Office*